US009905157B2

(12) United States Patent
Yang

(10) Patent No.: US 9,905,157 B2
(45) Date of Patent: Feb. 27, 2018

(54) PIXEL CIRCUIT AND ITS DRIVING METHOD AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventor: Shengji Yang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 350 days.

(21) Appl. No.: 14/763,028

(22) PCT Filed: Oct. 15, 2014

(86) PCT No.: PCT/CN2014/088690
§ 371 (c)(1),
(2) Date: Jul. 23, 2015

(87) PCT Pub. No.: WO2016/004693
PCT Pub. Date: Jan. 14, 2016

(65) Prior Publication Data

US 2016/0247443 A1 Aug. 25, 2016

(30) Foreign Application Priority Data

Jul. 10, 2014 (CN) ..... 2014 1 0328373

(51) Int. Cl.

| | |
|---|---|
| ***G09G 3/30*** | (2006.01) |
| ***G09G 3/3208*** | (2016.01) |
| ***G09G 3/20*** | (2006.01) |
| ***G09G 3/3233*** | (2016.01) |

(52) U.S. Cl.
CPC ..... *G09G 3/3208* (2013.01); *G09G 3/2092* (2013.01); *G09G 3/3233* (2013.01);
(Continued)

(58) Field of Classification Search
CPC .. G09G 3/3208; G09G 3/3233; G09G 3/2092; G09G 2300/0842;
(Continued)

(56) References Cited

U.S. PATENT DOCUMENTS

2011/0134100 A1* 6/2011 Chung ..... G09G 3/325 345/212
2014/0049169 A1* 2/2014 Li ..... H05B 33/0896 315/173

FOREIGN PATENT DOCUMENTS

CN 101739955 A 6/2010
CN 103000134 A 3/2013
(Continued)

OTHER PUBLICATIONS

International Search Report dated Apr. 16, 2015; PCT/CN2014/088690.
(Continued)

*Primary Examiner* — Nelson Rosario
*Assistant Examiner* — Gerald Oliver
(74) *Attorney, Agent, or Firm* — Ladas & Parry LLP; Loren K. Thompson

(57) ABSTRACT

There are provided a pixel circuit and its driving method and a display apparatus. The pixel circuit comprises: a first switching unit (T1) configured to provide operating voltage to a driving unit (DT), a second switching unit (T2) configured to reset voltage of a control terminal of the driving unit (DT), a third switching unit (T3) configured to write data voltage on a data voltage line (Vdata) into an energy storage unit (C), a fourth switching unit (T4) configured to
(Continued)

connect the control terminal and output terminal of the driving unit (DT), a fifth switching unit (T5) configured to conduct driving current to an electroluminescent unit (L), the driving unit (DT), the energy storage unit (C) and the electroluminescent unit (L). The pixel circuit is capable of solving the problem of non-uniformity of display luminance because of the threshold voltage drift of the driving transistor.

20 Claims, 6 Drawing Sheets

(52) U.S. Cl.
CPC ..... *G09G 2300/0819* (2013.01); *G09G 2300/0842* (2013.01); *G09G 2300/0861* (2013.01); *G09G 2320/0233* (2013.01); *G09G 2320/043* (2013.01)

(58) Field of Classification Search
CPC ..... G09G 2300/0819; G09G 2320/043; G09G 2300/0861; G09G 2320/0233
See application file for complete search history.

(56) References Cited

FOREIGN PATENT DOCUMENTS

| | | | |
|---|---|---|---|
| CN | 103226931 | A | 7/2013 |
| CN | 103474024 | A | 12/2013 |
| CN | 103886838 | A | 6/2014 |
| CN | 104078006 | A | 10/2014 |
| CN | 104102382 | A | 10/2014 |
| CN | 203950534 | A | 11/2014 |
| EP | 2985679 | A1 | 2/2016 |
| EP | 3163562 | A1 | 5/2017 |
| KR | 20120000434 | A | 1/2012 |
| KR | 20130075184 | A | 7/2013 |

OTHER PUBLICATIONS

International Preliminary Report on Patentability dated Jan. 10, 2017; PCT/CN2014/088690.
Extended European Search Report dated Nov. 10, 2017; Appln. 14882163.0.

* cited by examiner

PIXEL CIRCUIT AND ITS DRIVING METHOD AND DISPLAY APPARATUS

TECHNICAL FIELD

The present disclosure relates to a pixel circuit and its driving method, and a display apparatus.

BACKGROUND

An organic light emitting display (OLED) is a hot topic in the present flat panel display research field. Compared with a liquid crystal display, OLED has advantages of low power consumption, low production cost, self-luminescent, broad viewing angle, and fast response speed and so on. At present, in the display field of a mobile phone, a PDA and a digital camera and the like, OLED has started to replace a traditional LCD display screen. The pixel driving circuit design is a core technical content of the OLED display, and has important research significance.

Unlike a thin film transistor liquid crystal display (TFT-LCD) that utilizes a stable voltage to control luminance, OLED belongs to a current-driven display and needs a stable current to control light emitting.

Due to process manufacturing and device aging and so on, in the traditional 2T1C driving circuit (comprising two thin film transistors and one capacitor), the threshold voltage of the driving TFT of respective pixel points has non-uniformity, which results in that the current flowing through OLED of each pixel point changes, so that the display luminance is non-uniform, thereby influencing the display effect of the entire image.

SUMMARY

There provides in embodiments of the present disclosure a pixel circuit, comprising a driving unit, an energy storage unit and an electroluminescent unit, and further comprising:

a first switching unit having a control terminal connected to a first scanning signal line, a first terminal connected to an operating voltage line, and a second terminal connected to an input terminal of the driving unit, and configured to provide operating voltage to the driving unit under the control of the first scanning signal line;

a second switching unit having a control terminal connected to a second scanning signal line, a first terminal connected to a control terminal of the driving unit, and a second terminal is grounded, and configured to reset voltage of the control terminal of the driving unit under the control of the second scanning signal line;

a third switching unit having a control terminal connected to a third scanning signal line, a first terminal connected to a first terminal of the energy storage unit, and a second terminal connected to a data voltage line, and configured to write data voltage on the data voltage line into the first terminal of the energy storage unit under a control of the third scanning signal line;

a fourth switching unit having a control terminal connected to the third scanning signal line, a first terminal connected to an output terminal of the driving unit, and a second terminal connected to the control terminal of the driving unit and a second terminal of the energy storage unit, and configured to connect the control terminal and output terminal of the driving unit under the control of the third scanning signal line and enable the voltage of the output terminal of the driving unit to charge the second terminal of the energy storage unit; and a fifth switching unit having a control terminal connected to a fourth scanning signal line, a first terminal connected to the output terminal of the driving unit, and a second terminal connected to the electroluminescent unit, and configured to conduct driving current generated by the driving unit to the electroluminescent unit under the control of the fourth scanning signal line.

Alternatively, respective switching units and the driving unit are thin film transistors. Control terminals of the respective switching units are gates of the thin film transistors, first terminals thereof are sources of the thin film transistors, and second terminals thereof are drains of the thin film transistors. The input terminal of the driving unit is a source of a thin film transistor, the control terminal thereof is a gate of the thin film transistor, and the output terminal thereof is a drain of the thin film transistor.

Alternatively, the respective thin film transistors are P channel type transistors.

Alternatively, the energy storage unit is a capacitor.

Alternatively, the electroluminescent unit is an organic light emitting diode.

Alternatively, an operating period of time for each frame comprises a charging phase, a transition phase and a light emitting phase.

In the charging phase, a scanning voltage is applied to a scanning signal line, only the first switching unit, the third switching unit and the fourth switching unit are made to be turned on, and a first data voltage is applied to the data voltage line;

In the transition phase, the scanning voltage is applied to the scanning signal line, only the third switching unit and the fourth switching unit are made to be turned on, and a second data voltage is applied to the data voltage line; the second data voltage is smaller than the first data voltage.

Alternatively, the operating period of time for each frame further comprises a resetting phase, in which the scanning voltage is applied to the scanning signal line, and only the second switching unit is made to be turned on.

Alternatively, in the light emitting phase, the first switching unit and the fifth switching unit are made to be turned on.

There further provides in an embodiment of the present disclosure a display apparatus, comprising the pixel circuit described above.

In the pixel circuit provided in the embodiments of the present disclosure, the operating current flowing through the electroluminescent unit is not affected by the threshold voltage of the corresponding driving transistor, which thoroughly solves the problem of non-uniformity of display luminance because of the threshold voltage drift of the driving transistor. Furthermore, the pixel circuit in the embodiments of the present disclosure reduces the number of signal lines used for the pixel circuit in the display apparatus, reduces the cost of an integrated circuit, and at the same time raises pixel density of the display apparatus.

DETAILED DESCRIPTION

Specific implementations of the present disclosure would be further described below in combination with the accompanying figures. Following embodiments are only used to explain solutions of the present disclosure more clearly, but should not be considered as to limit a protection scope of the present disclosure.

Figure 1:
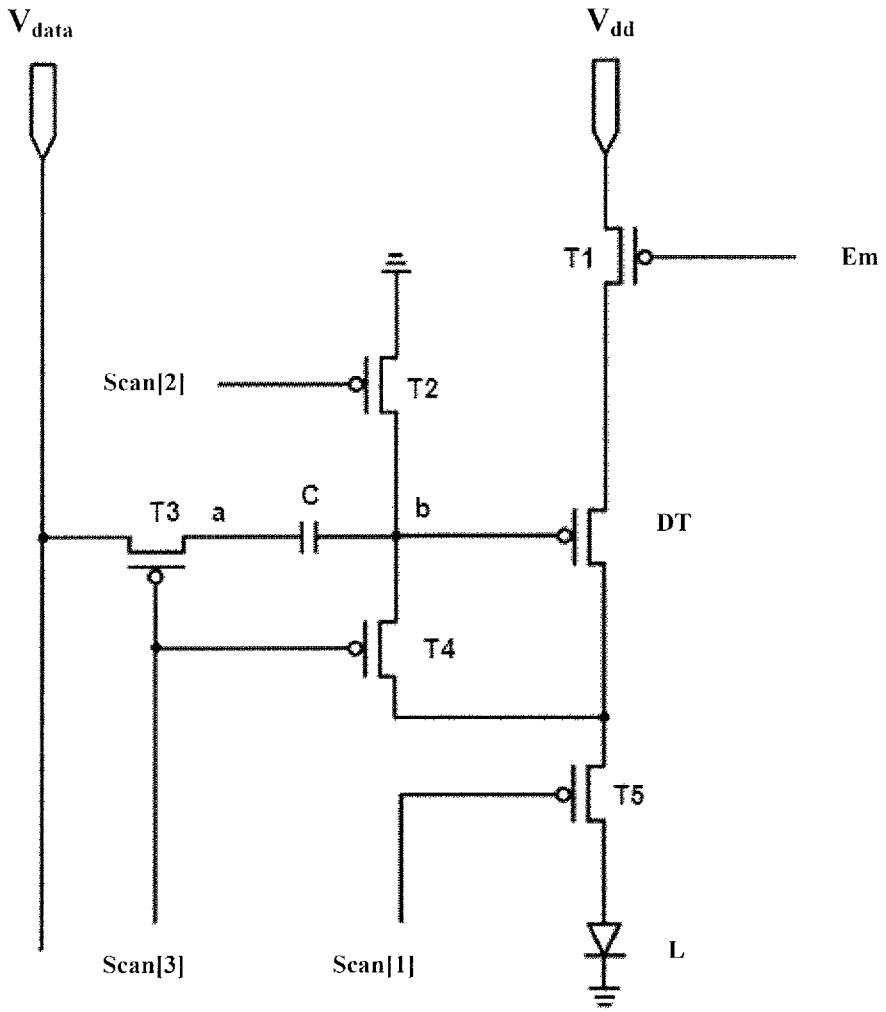
FIG. 1 is a schematic diagram illustrating a structure of a pixel circuit provided in an embodiment of the present disclosure.

FIG. 1 is a schematic diagram illustrating a structure of a pixel circuit provided in an embodiment of the present disclosure. As shown in FIG. 1, the pixel circuit comprises: five switching units T1, T2, T3, T4, T5, and one driving unit DT, one energy storage unit C, and one electroluminescent unit L.

A control terminal of the switching unit T1 is connected to a first scanning signal line Em; a first terminal thereof is connected to an operating voltage line $V_{dd}$, and a second terminal thereof is connected to an input terminal of the driving unit DT.

A control terminal of the switching unit T2 is connected to a second scanning signal line Scan[2], a first terminal thereof is connected to a control terminal of the driving unit DT, and a second terminal thereof is grounded.

Control terminals of the switching units T3 and T4 are connected to a third scanning signal line Scan[3]; a first terminal of T3 is connected to a first terminal a of the energy storage unit C, a second terminal thereof is connected to a data voltage line $V_{data}$; a first terminal of T4 is connected to an output terminal of the driving unit DT, a second terminal thereof is connected to the control terminal of the driving unit DT and a second terminal b of the energy storage unit C connected to the control terminal of the driving unit DT.

A control terminal of the switching unit T5 is connected to a fourth scanning signal line Scan[1], a first terminal thereof is connected to the output terminal of the driving unit DT, and a second terminal thereof is connected to the electroluminescent unit L.

It shall be understood that in the embodiment of the present disclosure, a plurality of switching units whose control terminals are connected to a same scanning signal line (for example, two switching units T3 and T4 connected to Scan[3]) should be switching units of the same channel type, i.e., all being turned on at a high level or all being turned on at a low level, so as to ensure that the two switching units connected to the same scanning signal line have a same turn-on or turn-off state.

In the pixel circuit provided in the embodiment of the present disclosure, the operating current flowing through the electroluminescent unit is not affected by the threshold voltage of the corresponding driving transistor, which thoroughly solves the problem of non-uniformity of display luminance because of the threshold voltage drift of the driving transistor. Furthermore, the pixel circuit in the embodiment of the present disclosure reduces the number of signal lines used for the pixel circuit in the display apparatus, reduces a cost of an integrated circuit, and at the same time raises pixel density of the display apparatus.

Alternatively, respective switching units and the driving unit are thin film transistors TFTs. Control terminals of the respective switching units are gates of thin film transistors, first terminals thereof are sources of the thin film transistors, and second terminals thereof are drains of the thin film transistors. The input terminal of the driving unit is a source of a thin film transistor, the control terminal thereof is a gate of the thin film transistor, and an output terminal thereof is a drain of the thin film transistor.

It is not difficult to understand that transistors corresponding to the driving units and the switching units herein may be transistors whose sources and drains can be exchanged, or according to different types of turn-on, first terminals of the respective switching unit and the driving unit may be drains of the transistors, and second terminals thereof may be sources of the transistors. Circuit structures which are obtained from inverse connection of sources and drains of the respective transistors in the pixel circuit provided in the embodiment of the present disclosure by those skilled in the art without paying any inventive labor and are capable of achieving a technical effect the same as or similar to the technical effect achieved by the technical solution provided in the embodiment of the present disclosure shall be fallen into the protection scope of the present disclosure.

Further, in the embodiment of the present disclosure, all the respective thin film transistors are P channel type transistors. By utilizing the same type of transistors, uniformity of processes can be achieved, so that a yield rate of products can be increased. Those skilled in the art can understand that, the types of the respective transistors may be not same in the actual application, for example, T3 and T4 may be the N channel type transistors or the P channel type transistors, while switching types of T1, T2 and T5 can be selected randomly. As long as two switching elements whose control terminals are connected to the same scanning signal line have a same turn-on/turn-off state, the solutions provided in the present disclosure can be implemented. Alternative implementations of the present disclosure should not be constructed as limitations to the protection scope of the present disclosure.

Alternatively, the energy storage C is a capacitor. Of course, other elements having an energy storing function can also be used according to the design requirements in the actual application.

Alternatively, the electroluminescent unit L can be an organic light emitting diode (OLED). Of course, other elements having an electroluminescent function can also be used according to the design requirements in the actual application.

Figure 2:
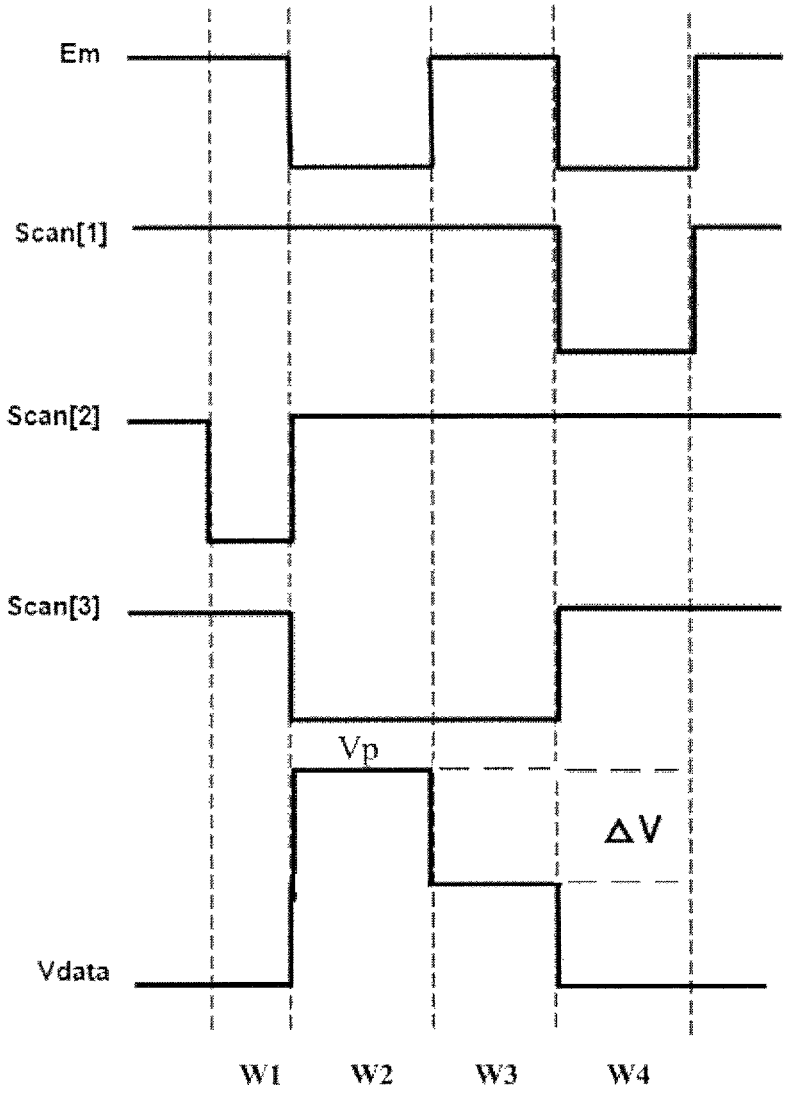
FIG. 2 is a timing diagram of essential signals in the pixel circuit provided in an embodiment of the present disclosure

FIG. 2 shows a timing diagram of essential signals in the pixel circuit provided in an embodiment of the present disclosure. FIGS. 3*a*-3*d* show the schematic diagrams of current flow directions and voltage values for the pixel circuit under different timings in an embodiment of the present disclosure. The driving method of the pixel circuit provided in the alternative embodiment of the present disclosure will be described below in detail by combining with FIGS. 2 and 3. As shown in FIG. 2, the timing of scanning signals input to respective scanning signal lines when the pixel circuit provided in the present disclosure operates can be divided into four phases. The four phases are represented in FIG. 2 as a resetting phase W1, a charging phase W2, a transition phase W3, and a light emitting phase W4, respectively. In the respective phases, the current flow directions and the voltage values in the pixel circuit are as shown in FIGS. 3*a*, 3*b*, 3*c* and 3*d*, respectively. For a purpose of making it convenient for description, it is assumed that the respective switching units are the P channel type TFTs.

Figure 3A:
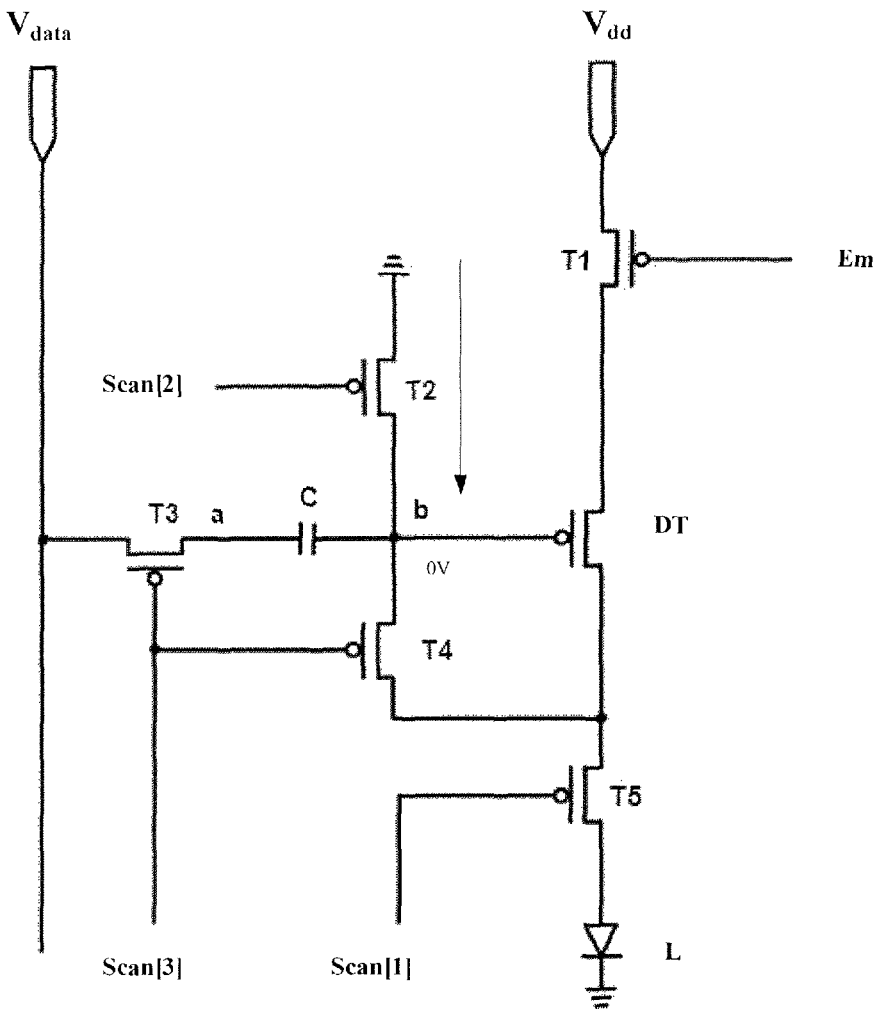
FIGS. 3*a*-3*d* are schematic diagrams illustrating current flow directions and voltage values for the pixel circuit under different timings in an embodiment of the present disclosure.

In the resetting phase W1, as shown in FIG. 2, Scan[2] is at a low level, and other scanning signal lines are at a high level. Now, T2 is turned on, T1, T3, T4 and T5 are turned off. Referring to FIG. 3*a*, at this time, a node b is connected to the ground, and has a potential of 0V.

Figure 3B:
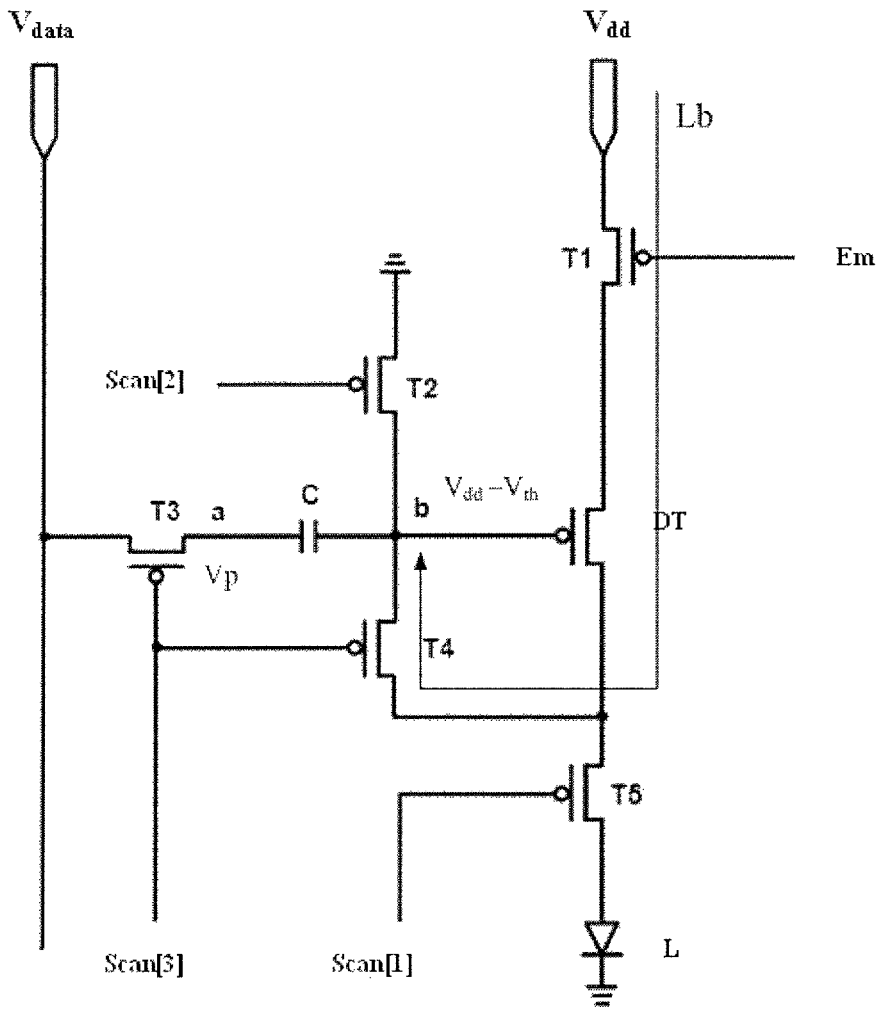

In the charging phase W2, as shown in FIG. 2, Scan[1] and Scan[2] are at the high level, other scanning signal lines are at the low level, and $V_{data}=V_p$. Now, T1, T3, and T4 are turned on, and T2 and T5 are turned off. Since the node b is connected to the ground and has the potential of 0 in the previous phase, DT is turned on at this time, the voltage line $V_{dd}$ starts to charge the node b through Lb (T1→DT→T4) as shown in FIG. 3*b*, until the voltage at the node b is charged to be $V_{dd}-V_{th}$ (it is satisfied that a voltage difference between the gate and source of DT is $V_{th}$, wherein $V_{th}$ is a threshold voltage of the driving unit DT). During this process, since a node a is connected to the signal $V_{data}$ and its potential is set as $V_p$, after the charging is ended, a potential difference between the nodes a and b would be always maintained at $V_{dd}-V_{th}-V_p$. In addition, since T5 is turned off, the current would not flow through the electroluminescent unit L, which indirectly reduces the service life loss of L.

Figure 3C:
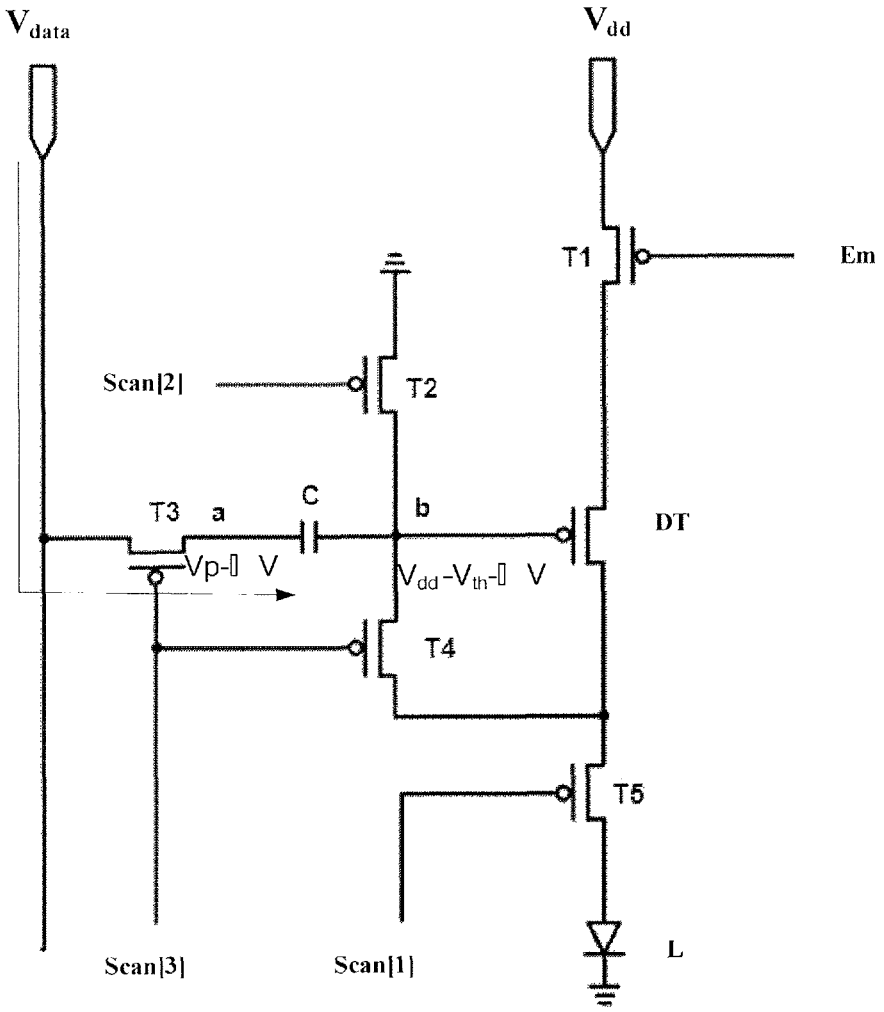

In the transition phase W3, as shown in FIG. 2, Scan[3] is at the low level, and other scanning signal lines are at the high level. Now, T3 and T4 are tuned on, $V_{data}=V_p-\Delta V$. Herein, ΔV can be selected according to the actual control requirements. Referring to FIG. 3*c*, the potential at the node a is changed into $V_p-\Delta V$. Since the node b is floated and Va and Vb realize a same amount of voltage jump (i.e., maintaining the original voltage difference, which is $V_{dd}-V_{th}-V_p$, the potential at the node b is $Vb=V_{dd}-V_{th}-\Delta V$ and maintains stable.

Figure 3D:
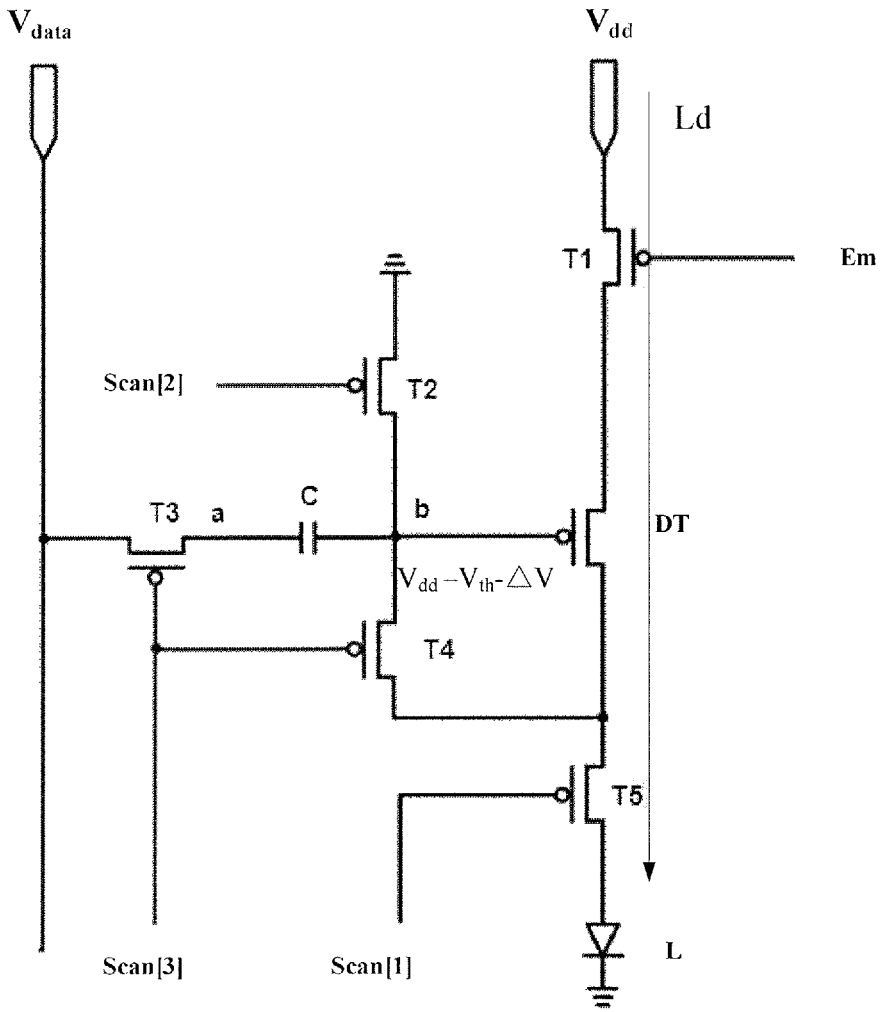

In the light emitting phase W4, as shown in FIG. 2, Em and Scan[1] are at the low level, and Scan[2] and Scan[3] are at the high level. Now, T1 and T5 are turned on. Referring to FIG. 3*d*, at this time, $V_{dd}$ supplies the current to the electroluminescent unit L along Ld, so that L emits light.

The following formula can be obtained from a TFT saturation current formula:

$$I_L = K(V_{GS} - V_{th})^2 = K[Vdd - (V_{dd} - Vth + \Delta V) - Vth]^2 = K \cdot (\Delta V)^2$$

It can be seen from the above formula that the operating current flowing through the electroluminescent unit L is not affected by the threshold voltage of the driving transistor at this time, and is only related to the data voltage $V_{data}$. In this way, a problem of the threshold voltage ($V_{th}$) drift caused by the manufacturing process and long-time operation of the driving transistor TFT is thoroughly solved, its effect on the current flowing through the electroluminescent unit is eliminated, and normal operation of the electroluminescent unit is ensured.

Based on the same concept, there further provides in an embodiment of the present disclosure a display apparatus, comprising the pixel circuit described above.

The display apparatus can be any product or means having a display function such as an electronic paper, a mobile phone, a tablet computer, a television, a display, a notebook computer, a digital photo frame and a navigator and the like.

The above descriptions are just exemplary embodiments of the present disclosure. It shall be pointed out that various improvements and modifications can be made without departing from the technical principle of the present disclosure for those skilled in the art and these improvements and modifications shall be deemed as falling into the protection scope of the present disclosure.

The present application claims the priority of a Chinese patent application No. 201410328373.1 filed on Jul. 10, 2014. Herein, the content disclosed by the Chinese patent application is incorporated in full by reference as a part of the present disclosure.

What is claimed is:

1. A pixel circuit, comprising a driving unit, an energy storage unit and an electroluminescent unit, and further comprising:

a first switching unit having a control terminal connected to a first scanning signal line, a first terminal connected to an operating voltage line, and a second terminal connected to an input terminal of the driving unit, and configured to provide operating voltage to the driving unit under the control of the first scanning signal line;

a second switching unit having a control terminal connected to a second scanning signal line, a first terminal connected to a control terminal of the driving unit, and a second terminal is grounded, and configured to reset voltage of the control terminal of the driving unit under the control of the second scanning signal line;

a third switching unit having a control terminal connected to a third scanning signal line, a first terminal connected to a first terminal of the energy storage unit, and a second terminal connected to a data voltage line, and configured to write data voltage on the data voltage line into the first terminal of the energy storage unit under the control of the third scanning signal line;

a fourth switching unit having a control terminal connected to the third scanning signal line, a first terminal connected to an output terminal of the driving unit, and a second terminal connected to the control terminal of the driving unit and a second terminal of the energy storage unit, and configured to connect the control terminal and output terminal of the driving unit under the control of the third scanning signal line and enable the voltage of the output terminal of the driving unit to charge the second terminal of the energy storage unit; and a fifth switching unit having a control terminal connected to a fourth scanning signal line, a first terminal connected to the output terminal of the driving unit, and a second terminal connected to the electroluminescent unit, and configured to conduct driving current generated by the driving unit to the electroluminescent unit under the control of the fourth scanning signal line.

2. The pixel circuit according to claim 1, wherein respective switching units and the driving unit are thin film transistors, control terminals of the respective switching units are gates of the thin film transistors, first terminals thereof are sources of the thin film transistors, and second terminals thereof are drains of the thin film transistors, and the input terminal of the driving unit is a source of a thin film transistor, the control terminal thereof is a gate of the thin film transistor, and the output terminal thereof is a drain of the thin film transistor.

3. The pixel circuit according to claim 2, wherein the respective thin film transistors are P channel type transistors.

4. The pixel circuit according to claim 3, wherein the energy storage unit is a capacitor.

5. The pixel circuit according to claim 3, wherein the electroluminescent unit is an organic light emitting diode.

6. The pixel circuit according to claim 2, wherein the energy storage unit is a capacitor.

7. The pixel circuit according to claim 2, wherein the electroluminescent unit is an organic light emitting diode.

8. The pixel circuit according to claim 1, wherein the energy storage unit is a capacitor.

9. The pixel circuit according to claim 8, wherein the electroluminescent unit is an organic light emitting diode.

10. The pixel circuit according to claim 1, wherein the electroluminescent unit is an organic light emitting diode.

11. A method for driving the pixel circuit according to claim 1, wherein an operating period of time for each frame comprises a charging phase, a transition phase and a light emitting phase, and the method comprises following steps:

in the charging phase, applying a scanning voltage to a scanning signal line, making only the first switching unit, the third switching unit and the fourth switching unit turned on, and applying a first data voltage to the data voltage line;

in the transition phase, applying the scanning voltage to the scanning signal line, making only the third switching unit and the fourth switching unit turned on, and applying a second data voltage to the data voltage line;

wherein the second data voltage is smaller than the first data voltage.

12. The method according to claim 11, wherein the operating period of time for each frame further comprises a resetting phase, in which the scanning voltage is applied to the scanning signal line, and only the second switching unit is made to be turned on.

13. The method according to claim 11, wherein the first switching unit and the fifth switching unit are made to be turned on in the light emitting phase.

14. A display apparatus, comprising the pixel circuit according to claim 1.

15. The display apparatus according to claim 14, wherein respective switching units and the driving unit are thin film transistors, control terminals of the respective switching units are gates of the thin film transistors, first terminals thereof are sources of the thin film transistors, and second terminals thereof are drains of the thin film transistors, and the input terminal of the driving unit is a source of a thin film transistor, the control terminal thereof is a gate of the thin film transistor, and the output terminal thereof is a drain of the thin film transistor.

16. The display apparatus according to claim 15, wherein the respective thin film transistors are P channel type transistors.

17. The display apparatus according to claim 15, wherein the energy storage unit is a capacitor.

18. The display apparatus according to claim 15, wherein the electroluminescent unit is an organic light emitting diode.

19. The display apparatus according to claim 14, wherein the energy storage unit is a capacitor.

20. The display apparatus according to claim 14, wherein the electroluminescent unit is an organic light emitting diode.

* * * * *